United States Patent [19]

Grant

[11] Patent Number: 4,949,647

[45] Date of Patent: Aug. 21, 1990

[54] COLLAPSIBLE PLATFORM ASSEMBLY

[76] Inventor: Alvin S. Grant, 1836 Wright St., Pittsburgh, Pa. 15221

[21] Appl. No.: 328,898

[22] Filed: Mar. 27, 1989

[51] Int. Cl.[5] ..... A47B 5/00

[52] U.S. Cl. ..... 108/48; 108/38

[58] Field of Search ..... 108/48, 42, 38, 34, 108/35, 36, 134, 135, 152; 248/240, 240.2

[56] References Cited

U.S. PATENT DOCUMENTS

| | | | |
|---|---|---|---|
| 875,840 | 1/1908 | Olsen | 108/48 |
| 1,700,545 | 1/1929 | Sanders | 108/38 X |
| 1,849,184 | 5/1932 | Gay | 108/48 |
| 2,353,331 | 7/1944 | Hall | 248/240.2 X |
| 2,943,896 | 7/1960 | Gaston | 108/134 |
| 3,866,548 | 2/1975 | Siconieczny | 108/48 X |

*Primary Examiner*—José V. Chen

*Attorney, Agent, or Firm*—Clifford A. Poff

[57] ABSTRACT

A foot-actuated collapsible platform assembly which may be positioned in an upright, horizontal position providing a horizontal surface, or, alternatively, in a vertical, storage position. The platform is rotated into and out of the upright, horizontal position by the exertion of a force upon a foot pedal. The collapsible platform assembly may be operated by a user by placing a foot on the foot pedal and exerting a force thereupon.

5 Claims, 3 Drawing Sheets

COLLAPSIBLE PLATFORM ASSEMBLY

BACKGROUND OF THE INVENTION

1. Field of the Invention

The present invention relates generally to collapsible platforms, and, more particularly, to a collapsible platform which may alternatively be positioned in an upright, horizontal position, or, in a vertical, storage position, wherein a user causes rotation of the collapsible platform into and out of position by actuation of a foot petal.

2. Description of the Prior Art

Known in the art are various platforms which may be rotated into and out of a horizontal position. Disclosed in U.S. Pat. No. 4,100,858 by Bue et al. is one such platform. The platform is movable between a vertical storage position against a wall, and a horizontal position. A hinge assembly pivotally connecting the platform to the wall allows a user to rotate the platform into and out of position. The platform is rotated into and out of position by applying an upward or downward force to the platform. Disclosed in U.S. Pat. No. 3,696,762 to Holdham is a platform which may similarly be rotated into and out of a horizontal position by the application of an upward or a downward force to the platform. Disclosed in U.S. Pat. No. 3,285,206 to Hoffman and U.S. Pat. No. 2,817,571 to Lee are collapsible platforms containing springs to exert spring forces to aid in the maintenance of a horizontal position of the respective platforms. Other collapsible platforms are similarly known in the art, and include, U.S. Pat. No. 1,917,336 to Spitz, U.S. Pat. No. 2,943,896 to Gaston, U.S. Pat. No. 4,100,858 to Bue et al., and U.S. Pat. No. 4,437,414 to Brescia et al.

Each prior art collapsible platform, however, requires a user to manually rotate the platform into or out of position by applying a torque to a platform with the hands of the user. In some instances, the user is unable to use his or her hands to rotate the platform into position. For instance, an individual with a handicap may find the required motions necessary to rotate a platform into or out of position to be difficult, if not impossible to perform. In other instances, the user may be carrying an object, or otherwise not have complete freedom of use of his or her hands to rotate the platform into or out of position.

It is accordingly the object of the present invention to provide a collapsible platform which may be rotated into or out of position by a user without the requirement of the user applying a force to the platform by the hands of the user.

SUMMARY OF THE INVENTION

In accordance with the present invention, a collapsible platform assembly allowing a user to position the platform in either an upright, horizontal position providing a horizontal surface upon which to place an object, or, alternatively, in a vertical position adjacent to a vertical support extending upwardly from a floor is disclosed. The collapsible platform includes a planar platform member having an upper surface and a lower surface, a pivotal support means for pivotally supporting the planar platform member to extend from the vertical support at a desired vertical height above the floor, and a foot-actuated rotation means slidably engaging with the planar platform member for rotating the planar platform member from the upright, horizontal position to the vertical, storage position, or, alternatively, from the vertical, storage position to the upright, horizontal position, wherein the foot-actuated rotation means is actuated by the application of a force thereto.

In one embodiment of the present invention, the vertical support extending upwardly from a floor is comprised of a wall. However, other means of vertical supports may similarly be utilized. In the preferred embodiment, the pivotal support means for pivotally supporting the planar platform member includes a fixture member and a hinge means having first and second sides connected theretogether by a hinge pin, wherein the fixture member is fixedly attached to the vertical support and wherein a first side of the hinge means is coupled to the fixture member and wherein the second side of the hinge means is coupled to the planar platform member.

The collapsible platform assembly, in the preferred embodiment, further includes a laterally extending guideway mounted to extend across the lower surface of the planar platform member. Preferably, the laterally extending guideway extends at an angle relative to the upper surface of the planar platform member. Further, the foot-actuated rotation means, in the preferred embodiment, is comprised of an angled rod member, a foot pedal mounting block, and a foot pedal, wherein a first end of the angled rod member slidably engages with the laterally extending guideway mounted beneath the planar platform member, a second end of the angled rod member has mounted thereto the foot pedal, and wherein the angled rod member is pivotally coupled along the length thereof to the foot pedal mounting block. In one embodiment, the angled rod member is comprised of two rod portions positioned in an end-to-end relation and releasably fastened theretogether by a fastening means. The angled rod portion is thereby adjustable in length to aid in the installation of the assembly. In the preferred embodiment, the foot pedal mounting block is further affixed to the floor.

BRIEF DESCRIPTION OF THE DRAWINGS

The present invention will be better understood when read in light of the accompanying drawings in which.

DESCRIPTION OF THE PREFERRED EMBODIMENTS

Figure 1B:
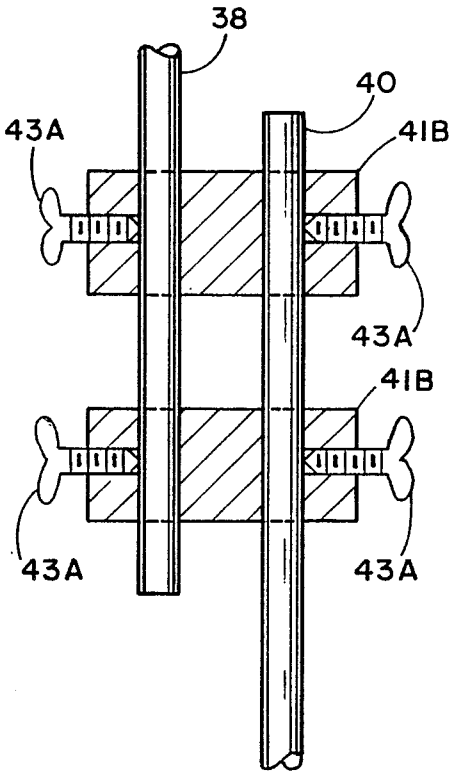
FIGS. 1A and 1B are detail views of the releasable fastening means which fastens together the two rod portions forming the angled rod member of the of the present invention.
Figure 1A:
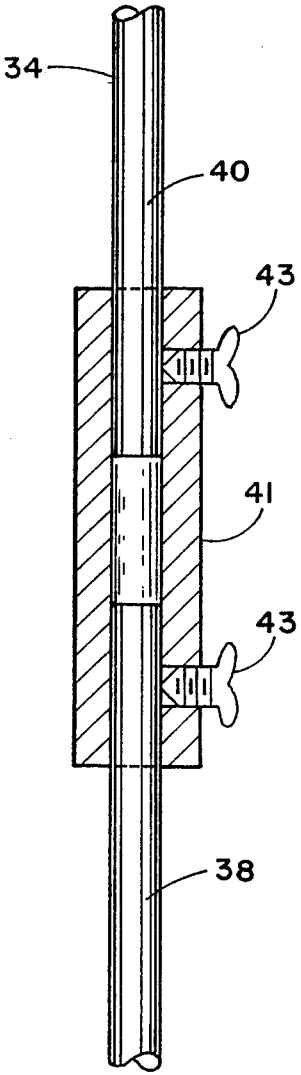
Figure 1:
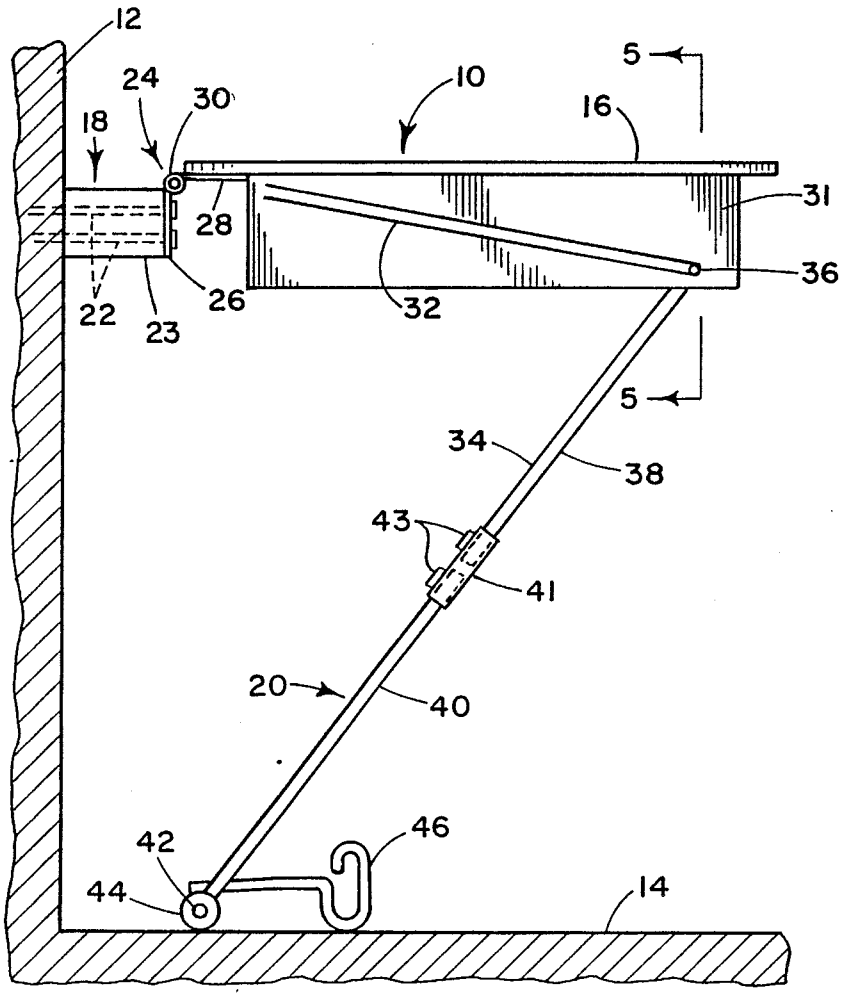
FIG. 1 is a side view, in elevation, of the collapsible platform assembly of the present invention positioned to provide a horizontal surface.

Referring first now to the side, elevational view of FIG. 1, there is illustrated the collapsible platform assembly, referred to generally by reference numeral 10, of the present invention. Collapsible platform assembly 10 in the preferred embodiment is supported from wall 12 at a desired height above floor 14; alternatively, however, assembly 10 may be supported by other vertical supports.

Collapsible platform assembly 10 is comprised of planar platform 16, support assembly 18, and foot-actuated rotation means 20. Support assembly 18 is affixed to wall 12 at a desired vertical height above floor 14 by any conventional manner; in the preferred embodiment illustrated in FIG. 1, assembly 18 is affixed to wall 12 by threaded screw members 22. Support assembly 18 includes fixture member 23 and hinge 24 having first arm 26 and second arm 28 pivotally connected theretogether by hinge pin 30. First arm 26 of hinge 24 is coupled to fixture member 23, and second arm 28 of hinge 24 is coupled to the lower surface of platform 16. In this manner, planar platform 16 may be pivotally supported at a desired height above floor 14.

Figure 5:
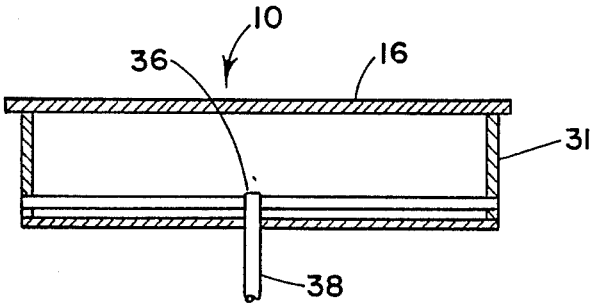
FIG. 5 is a sectional view taken along line 5—5 of FIG. 1.

Mounted from the bottom surface of platform 16 and extending along the length thereof are side rails 31 (both side rails 31 are illustrated in the sectional view of FIG. 5, one side rail 31 is shown in the elevational view of FIG. 1). Grooves forming guideway 32 are machined, or otherwise formed, to extend along the length of the platform 16. Foot-actuated rotation means 20 includes angled rod member 34, having first end portion 36 and, is positioned such that end portion 36 slidably engages with guideway 32. In the preferred embodiment, rod member 34 is formed of rod portion 38 and rod portion 40 positioned in an end to end relation and fastened theretogether by releasable fastening means 41. Portion 40 of angled rod 34 further forms an obtuse angle to allow pivotal coupling thereof at location 42 to foot pedal mounting block 44. Foot pedal mounting block 44 is affixed to floor 14. Mounted at an end of portion of angled rod 34 is foot pedal 46 of dimensions suitable to allow a foot of a user to be placed thereupon.

Illustrated in FIG. 1A is a detail view of fastening means 41. Fastening means 41 fastens end portions of rod portions 38 and 40 by means of, for example, wing nuts 43. Illustrated in FIG. 1B is a further embodiment of the fastening means which comprises two blocks 41A and 41B each provided with suitable openings to receive portions of rod members 38 and 40. The rod members are secured to the block by wing nuts 43A.

A force exerted upon foot pedal 46 causes upward or downward pivotal movement of the foot pedal 46 about location 42. Such movement, in turn, causes end portion 36 of angled rod 34 to slide along guideway 32. FIG. 1 illustrates the collapsible platform assembly 10 in an upright, horizontal position, in which angled rod 34 supports the platform 16 to provide a horizontal surface. An upward force exerted upon foot pedal 46 causes the end portion 36 of the angled rod 34 to translate in the leftward direction along guideway 32. Continued translation of the end portion 36 towards wall 12 removes the support provided by angled rod 34 to hold planar platform 16 in a horizontal position. Planar platform member 16 is thereby allowed to rotate about hinge pin 28 of support assembly 18.

Figure 2:
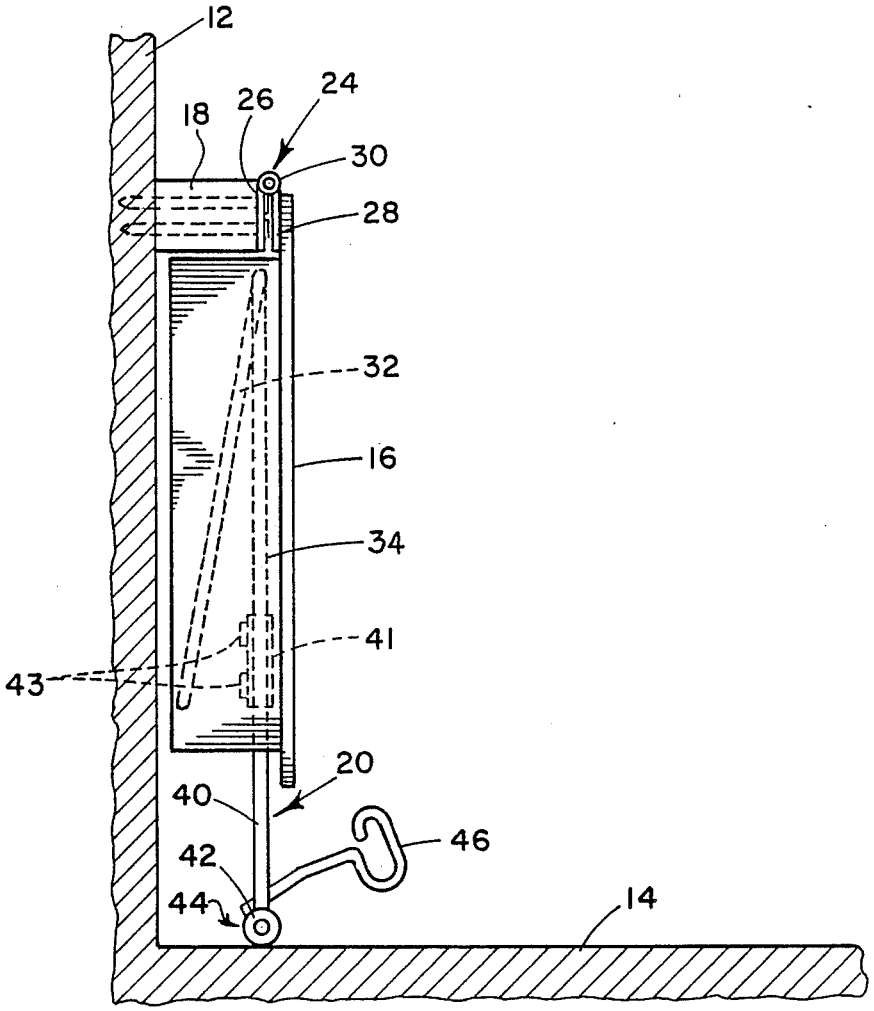
FIG. 2 is a side view, in elevation, of the collapsible platform assembly of FIG. 1 in which the platform assembly is in a vertical, storage position.

FIG. 2 illustrates the collapsible platform assembly 10 in which planar platform 16 is in the vertical position, and the end portion 36 of angled rod 34 has been translated along guideway 32 to a left-most position. When in this position, a downward force exerted upon foot pedal 46 causes rightward translation of end portion 36 along guideway 32, causing rotation of planar platform 16 about hinge pin 28 of support assembly 18. Once end portion 36 has been translated the full length along guideway 32 to the right-most portion thereof, planar platform 16 is once again in the upright, horizontal position illustrated in FIG. 1.

Figure 3A:
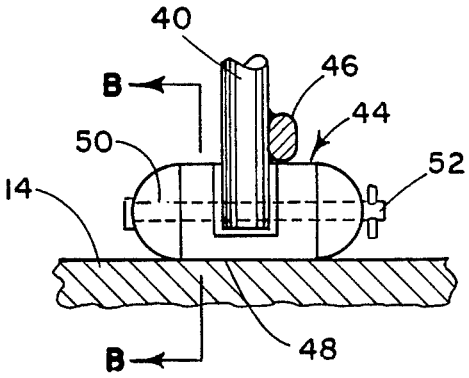
FIGS. 3A and 3B are detail views of the foot pedal mounting block which comprises a portion of the preferred embodiment of the present invention with FIG. 3B being a cross-sectional view taken through line B—B of FIG. 3A.
Figure 3B:
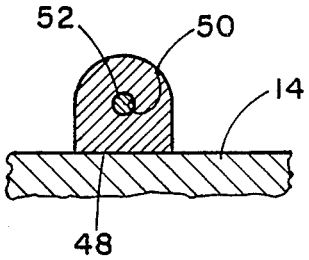

Referring now to the illustrations of FIGS. 3A and 3B, there are shown more detailed views of the foot pedal mounting block 44 of the collapsible platform assembly 10. In the preferred embodiment, foot pedal mounting block 44 is semi-cylindrical in shape having flat bottom surface 48. Flat bottom surface 48 allows supportive positioning of block 44 upon floor 14. Block 44 may be affixed in position upon floor 14 by any conventional fastening means, such as threaded screw fasteners. Extending horizontally through block 44, and as illustrated in the cross-sectional view of FIG. 3B, is cavity 50. Inserted to extend through cavity 50 is hinge pin 52 which allows the pivotal connection thereto of angled rod 34.

Figure 4:
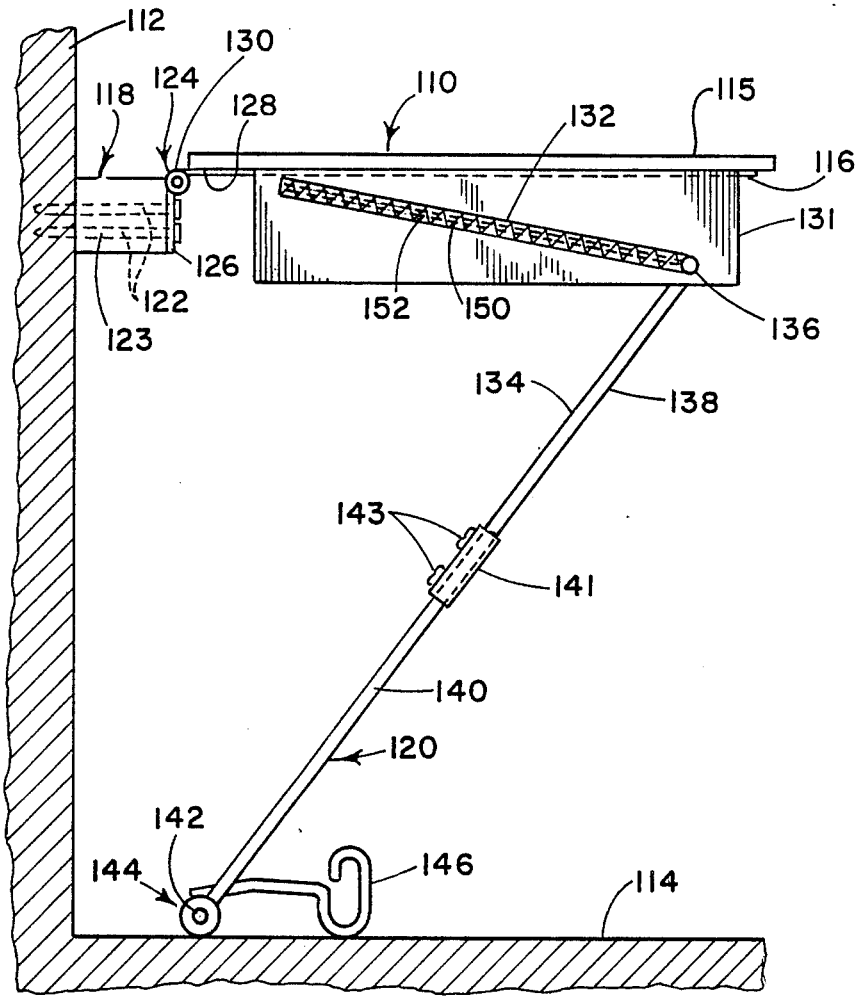
FIG. 4 is a side, elevational view of a further embodiment of the collapsible platform assembly of the present invention.

Referring now to the side, elevational view of FIG. 4, there is illustrated a further embodiment of the present invention. Similar to the embodiment of FIGS. 1–3, collapsible platform assembly 110 is affixed to wall 112 at a desired vertical height above floor 114. Planar platform member 115 forms a flat, supportive upper surface. Support assembly 118, comprised of fixture member 123 and hinge 124, is fixedly attached to wall 112 by means of threaded screw members 122. First arm 126 of hinge 124 is coupled to fixture member 123. Second arm 128 of hinge 124 is coupled to a rectangular frame 116 that can be made of $\frac{3}{8}''$ diameter rod. The frame is, in turn, secured to a platform member 115 forming the platform. The two hinge arms 126 and 128 are pivotally connected theretogether by means of hinge pin 130. Secured to opposite sides of the rectangular frame 116 are side rails 131 containing guideways 132. Footactuated rotation means 120 is comprised of angled rod 134 having end portion 136 which slidably engages with guideway 132. Again, angled rod 134 is formed of portions 138 and 140 connected theretogether by fastening means 141, with portion 140 being pivotally connected at location 142 to foot pedal mounting block 144. Attached to second end of angled rod 134 is foot pedal 146. In this embodiment, collapsible platform assembly 110 further includes spring member 150 for providing a spring force which aids in the translation of the end portion 136, and to maintain planar platform 115 in the horizontal position as illustrated in the Figure.

In this embodiment a guideway rod 152 extends along the length of guideway 132, separating the guideway 132 into two longitudinal portions. End portions 136 of angled rod 134 contains a slotted opening (not shown) to allow guideway rod 152 to extend therethrough. Spring member 150 surrounds the guideway rod to extend therethrough such that an end of spring member 150 abuts against end portion 136. Upward translation upon foot pedal 146 compresses spring 150 as end portion 136 is translated towards wall 112 to allow planar platform 115 to be positioned in a vertical, storage position.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A collapsible platform assembly allowing a user to position a platform in either a horizontal, upright position providing a horizontal surface upon which to place an object or, alternatively, in a vertical, storage position adjacent to a vertical support extending upwardly from a floor, said collapsible platform assembly including:

a planar platform member having an upper surface and a lower surface;

a support assembly having pivotal support means the vertical support at a desired vertical height above the floor; and foot-actuated rotation means for rotating the planar platform member; said foot-actuated rotation means including a rod member having a foot pedal mounted thereto, and extending therefrom, a foot pedal mounting block, wherein a first end of said rod member is slidably engaged with said lower surface, a second end of said rod member is pivotally coupled to said foot pedal mounting block, and said foot pedal mounting block is affixed to the floor, whereby, upon application of a force by a user's foot to said foot pedal, said planar platform is rotated by virtue of engagement with said rod member from the horizontal, upright position to the vertical, storage position, or, alternatively, from the vertical, storage position to the horizontal, upright position.

2. The collapsible platform assembly of claim 1 further including a laterally extending guideway extending beneath the lower surface of the planar platform member in which said rod member is slidably engaged.

3. The collapsible platform assembly of claim 2 wherein said rod member comprises an angled rod member for slidably engaging, at a first and thereof, with said laterally extending guideway.

4. The collapsible platform assembly of claim 3 wherein said angled rod member further includes means for adjusting the length of the rod member.

5. The collapsible platform assembly of claim 1 wherein said pivotal support means is comprised of: a fixture member adapted to be fixedly attached to the vertical support at said desired vertical height; and said pivotal support means forming a hinge having first and second sides connected theretogether by a hinge pin, wherein said first side is coupled to the fixture member, and said second side is coupled to the planar platform such that said second side and the planar platform member coupled thereto is permitted pivotal movement about said pin.

* * * * *